US005728266A

United States Patent [19]

Deslierres et al.

[11] Patent Number: 5,728,266

[45] Date of Patent: Mar. 17, 1998

[54] MACHINE AND PROCESS FOR THE MAKING OF PAPER AND CARDBOARD FROM COCONUT HUSKS

[76] Inventors: John M. Deslierres; Maria Do Rosario Cabedo, both of 2337 E. Brookdale Pl., Fullerton, Calif. 92631

[21] Appl. No.: 989,527

[22] Filed: Dec. 11, 1992

[51] Int. Cl.[6] ..... D01C 5/00

[52] U.S. Cl. ..... 162/99; 162/261; 162/258

[58] Field of Search ..... 241/7, 159, 271, 241/270; 162/21, 91, 99, 258, 28, 27, 261, DIG. 11, 263; 83/618, 951

[56] References Cited

U.S. PATENT DOCUMENTS

| | | | |
|---|---|---|---|
| 298,404 | 5/1884 | Priest | 241/270 |
| 497,911 | 5/1893 | Davis | 162/99 |
| 524,622 | 8/1894 | Walker | 241/270 |
| 1,181,553 | 5/1916 | Taylor | 162/99 |
| 1,717,798 | 6/1929 | Marr | 162/99 |
| 1,865,649 | 7/1932 | Skolnik | 162/28 |
| 1,884,075 | 10/1932 | Meyers | 162/258 |
| 2,857,238 | 10/1958 | Bulder | 162/99 |
| 3,284,285 | 11/1966 | Holden | 162/208 |
| 3,619,360 | 11/1971 | Persilt | 162/258 |
| 3,620,915 | 11/1971 | Keyeo et al. | 162/258 |
| 3,666,621 | 5/1972 | Adam | 162/258 |
| 3,945,881 | 3/1976 | Speidel | 162/208 |
| 4,915,821 | 4/1990 | Lamort | 162/55 |

OTHER PUBLICATIONS

Modern Pulp and Paper Making, Third Edition, Reinhold Publishing Corporation (New York, N.Y.). 1957, pp. 312–313.

Handbook of Pulp and Paper Technology, Kenneth Britt, Reinhold Publishing Corp., London (1964) pp. 296–299, 316–317 and 344–345.

*Primary Examiner*—Brenda A. Lamb

[57] ABSTRACT

A machine and process for using the fibrous material in coconut husks to manufacture paper and cardboard. The machine is designed to process intact coconuts wherein the copra and coconut milk contained therein are recovered as separate by-products for processing in their respective independent industries and process empty coconuts husks, coconuts wherein the copra and coconut milk have already been removed, by bypassing the copra and coconut milk extraction processing steps.

9 Claims, 2 Drawing Sheets

MACHINE AND PROCESS FOR THE MAKING OF PAPER AND CARDBOARD FROM COCONUT HUSKS

BACKGROUND

This invention relates to a new and unique machine and process for creating a suitable pulp to produce paper and cardboard from the fibrous and cellulose rich material of the coconut husks. In the harvesting and production of copra—the meat portion of the coconut, widely used in industry—the outer husk or shell is most of the times discarded because it is only used in the textile industry, in an incipient and limited quantity.

The machine illustrated represents one sole sequential operation with maintenance devices for simultaneous treatment of several units of the fruit (coconut).

1. Field of the Invention

This invention is directed to a machine for making paper products, in general, and to such a machine which makes the paper products out of coconut husks, in particular.

2. Prior Art

The inventors of the present patent application after an in depth study, found that the cellular structure of the coconut husk has properties that are conducive to achieving a high strength biodegradable paper or cardboard.

Cellulose occurs only in plants and vegetation material. In general, it is chemically inactive and insoluble in most liquids, and paper is composed chiefly of cellulose. Therefore, since the coconut husk is composed of long fibers rich in cellulose, these fibers can be processed into paper and cardboard. So, this invention presents a very useful method for processing a raw material abundant in tropical countries (and so far almost totally wasted), into a valuable final product—the paper pulp. It is, undoubtedly, a non-obvious process since the raw material has never been used for such purpose.

The manufacture of paper from the coconut shells will use the present state of the art of the paper industry that employs the cellulose of wood inserting the necessary innovations to adapt it to the new raw material.

PRIOR ART STATEMENT

The following patents reflect the state of the art:

| | | |
|---|---|---|
| American patents: | | |
| 3,907,603 | 9/1975 | Selander |
| 4,426,258 | 1/1984 | Browning |
| 4,582,568 | 4/1986 | Iyengar |
| 4,708,056 | 11/1987 | Dinanath |
| English patents: | | |
| 841,422 | 7/1960 | Berlyn |
| 1,050,687 | 12/1966 | Rogers Jr. |
| 1,064,949 | 4/1967 | Singer and Keller |
| 1,156,792 | 7/1969 | Lewis |
| 1,400,899 | 7/1975 | Breton |
| 1,437,398 | 5/1976 | Creusot-Loire |

SUMMARY OF THE INSTANT INVENTION

In the traditional process for the manufacture of paper, the cellulose fibers of various grades of wood are pulverized into small granules or sawdust like particles which then can be mixed with water to form an aqueous suspension or dispersion of fibers in a homogenous mass called "pulp".

This pulp solution is fluid enough in consistency to be dispersed through jets or nozzles onto a moving screen which, in the paper industry, is called "the wire". The screen or "wire" provides a means for laying up the wet pulp in a uniform thickness to form a web, and the excess of water is drained off. The pulp passes through two rollers with different functions: one squeezes the pulp to drain off the remaining liquid and the other to straighten the sheet which, over a felt conveyor, passes through heated cylinders for drying purposes and finally the sheet is then cooled and settled. The end of the traditional sequence is the feature that cuts the sheets and rolls them on drums.

The process for the making of paper presented by this invention follows the traditional procedure but, as mentioned before, it was necessary to add innovations to the state of the art in order to adapt the Machine to the new raw material: the coconut husks.

In fact, in one sole operational system, two different industries are interlocked: the use of the coconut copra (and liquid) and the making of paper and cardboard.

DESCRIPTION OF A PREFERRED EMBODIMENT

Figure 1:
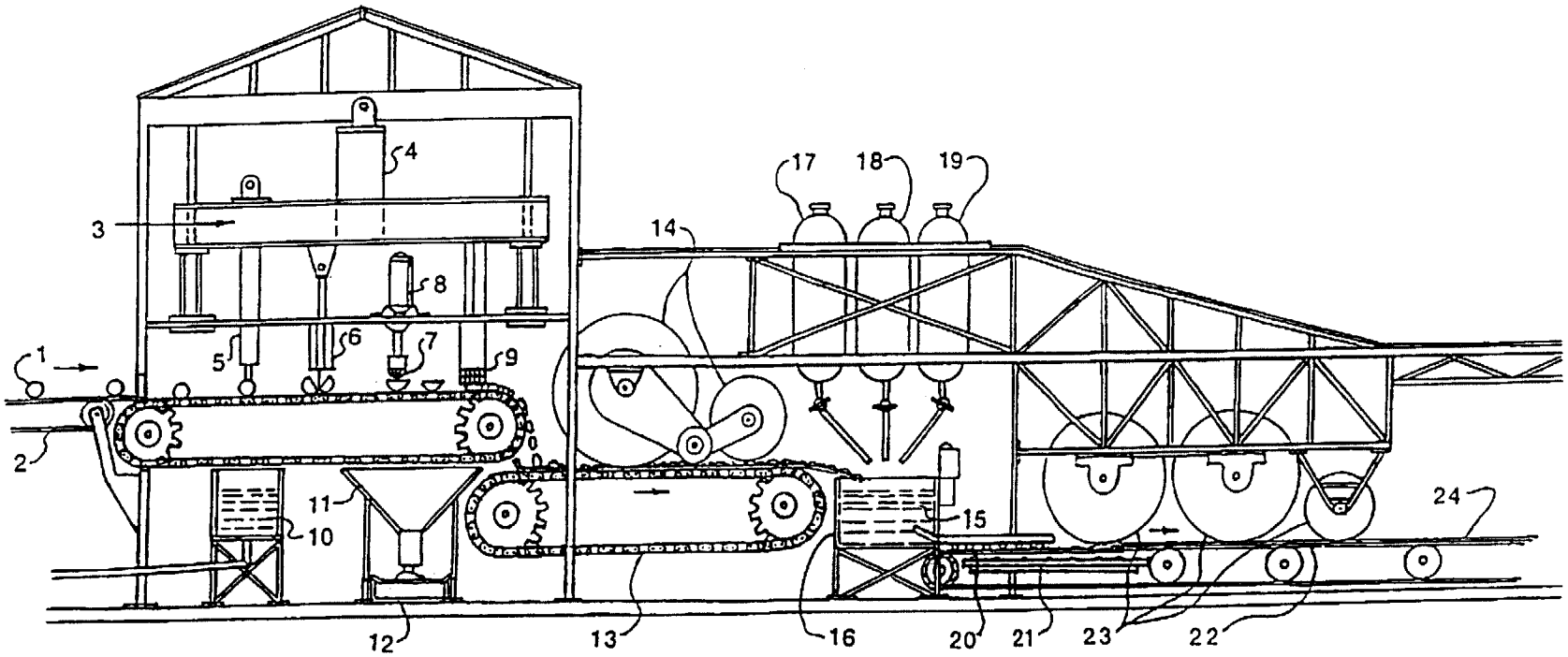
FIG. 1 is a schematic representation of the apparatus of the instant invention.
Figure 2:
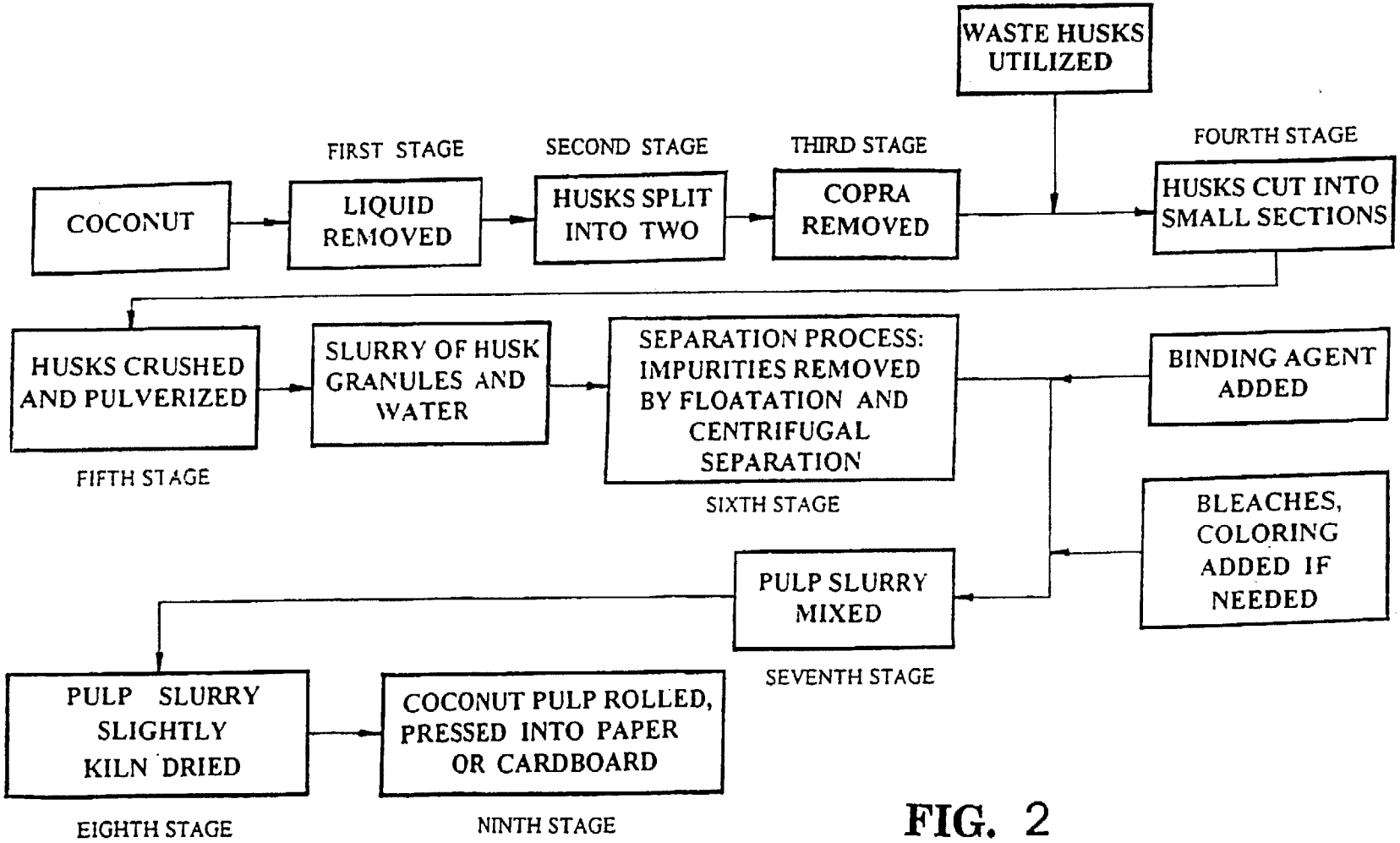
FIG. 2 is a flow chart diagram of the process of the instant invention.

The method and apparatus for making of paper or cardboard from the husks of coconuts are as presented in the following description.

The intact coconuts 1 are collected on a large conveyor 2 and then fed into a series of sectioning blades. A punch blade 5 perforates a longitudinal hole through the coconut so that the inside liquid falls into a container 10 existing under the machine, which container has a valve 57 and a flow out tube 50. The liquid is collected therein to be used in independent industry. A guillotine blade 6 that separates the coconut husks into two halves. A rotary ball cutter 7 with rotative and circular movement that penetrates the two halves of the coconut and extracts the copra. The copra falls into a funnel shape collector 11, the bottom opening of which permits the copra to be deposited on a second conveyor that conveys the copra to an independent industry. The two half coconut husks, now empty of copra, are then fed into a series of sectioning cutters 9 that shear the husks into small portions which fall into a conveyor 13 for handling and transmittal into flow tubes. The sheared bulks are then compressed under crusher rollers 14A and 14B and reduced to granular size. In this phase there may be a heating process of the defibered material so that it may attain the maximum degree of dryness which will make easy the subsequent phases of drawing out the water. The small sections of the husks are carried to treating "hollander" type tanks and mixed with water to remove the impurities therefrom. The resulting pulp is then additionally heated under pressure and soaked with a solution of sodium hydroxide or calcium hydrogen sulphite to dissolve the lignose and to yield a pulp composed of coconut cellulose fibers. This pulp is then washed with a chlorine solution (for instance chlorine dioxide) to bleach the cellulose fibers white. To avoid nodules, the pulp is again washed, this time with water and a percentage of sodium sulphite, the excess of water to be drained off.

Above the central part of the machine there are three reservoirs for storing products that will act sequentially during the process. These include a reservoir 17 of binding agent which agent can be natural or synthetic rosin, sodium hydroxide of aluminum sulphate; a reservoir 18 for a bleaching chlorine basis product and a reservoir 19 of coloring product.

The pulp is then pumped under pressure through a tube to another "hollander" tank that cuts the remaining fibers down into small size lengths. This is achieved with a series of rollers that contain projecting blades or knives 28 that pass among other fixed blades or knives set in a metal base plate. The pulp passing through these interdigitated dovetailed cutters is thoroughly disintegrated but still remains in a hair like cellulose condition. At this stage, a "filler" composed of talc or barium sulphate can be added to give consistency to the pulp. Such consistency is kept within pre-established limits by means of a sensor 25 existing in the binding agent reservoir 17, that issues a signal which turns "on" or "off" a discharge valve.

The resulting solution, homogeneous and fluid, is then ejected through jet nozzles onto the moving wire where it is spread or laid out in web or sheet form on the wire upper surface as a continuous moving web. The wire gauze permits dry air to be blown through it and the water to be drained off through the screen and aids drying. The moving wire passes then through a Fourdrinier paper machine 21 containing many heated rollers, hot presses and evaporative dewatering techniques that squeezes, sucks and applies pressure that drives the water out of the web of coconut pulp laying on the moving wire. The coconut paper sheet now has the conventional paper texture. It detaches from the wire and, laying on a conveyor 22 passes under heavy iron rollers 23A, 23B and/or 23C, for example, heated by steam that press the paper sheet thin in order to remove any residual water. Afterwards, it passses through polished cast iron rollers, called "calendars", under heavy pressure, to produce a smooth finish to the surface of the coconut paper product 24.

This coconut paper can be white or any other color, depending on the product discharged by the reservoir 19 of coloring product.

The paper or cardboard obtained by means of the process above referred to is equivalent in quality to the product achieved from wood. It is a very resistent biodegradable product and may present several textures and categories, depending on the needs of the paper industry.

This invention can either use intact coconuts (starting the process by extracting the internal liquid and the copra which are conveyed to independent industries) or alternatively use empty coconut husks or shells. In the latter case, the three starting blades of the machine, i.e., the punch blade 5, the guillotine blade 6 and the rotary ball cutter 7 do not exist or are disconnected since the coconuts that fall on the entrance conveyor are already empty and open. They enter the machine by the conveyor 2 and pass directly to be submitted to a series of sectioning cutters 9. The process that follows is then identical in both cases.

The most important characteristic of this invention is that the paper obtained from the husks of coconuts will use a raw material which is abundant in tropical countries but almost totally discarded. Hence, the economic value of the invention is very high.

Relevant is also the idea of the existence, from now on, of an alternative source to the paper industry, in the world worried about ecology, environment and the preservation of trees.

Thus, there is shown and described a unique design and concept of a machine for processing coconut husks into paper and cardboard. The particular configuration shown and described herein relates to an apparatus and process for making paper or cardboard from coconut husks. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A machine for processing coconuts into paper products, including:

cutter means which has ascendant and descendant movements to granulate husks of the coconuts;

crusher roller means to reduce the granulated husks to smaller particles;

a tank means to form a mixture of the smaller particles and water and removing impurities and undesirable constituents from the mixture, said tank means further comprises a metal base plate having fixed blades arranged thereon and a roller means having projecting blades, wherein the projecting blades pass among the fixed blades so as to reduce the smaller particles to a pulp;

a plurality of reservoirs suspended above said tank means, wherein said plurality of reservoirs includes first reservoir containing a binding agent, a second reservoir containing bleach and a third reservoir containing a coloring substance; and sensor control means for detecting the consistency of the pulp and operative to produce a signal, means responsive to said signal for spreading the binding agent over the pulp in order to maintain its consistency within pre-established limits whereby the pulp is used in manufacturing the paper products.

2. The machine of claim 1, including:

a heavy press comprised of a piston and a motor for synchronizing the movement of said heavy press and said piston with said cutter means;

a punch means for punching a hole through the coconuts to permit the internal liquid to be drained therefrom;

a container located beneath said punch means for receiving said internal liquid;

a valve and drain tube connected to said container;

a blade for cutting the coconut into as least two sections;

a rotary ball cutter with rotative and circular movements to penetrate the sections of the coconut and extract the copra therefrom;

a first conveyor for supporting and conveying the coconuts or the sections of the coconuts or the granulated husks past the punch means, the blade, the rotary ball cutter and the crusher roller means a funnel-shaped collector means to collect said copra; and a second conveyor which receives the copra from said collector.

3. The machine of claim 1, further comprising a moving wire gauze means arranged adjacent the tank means such that the pulp from the tank means is dispersed onto said wire gauze means forming a paper web.

4. The machine of claim 3, further comprising a calendaring means arranged adjacent said wire gauze means to smooth one surface of the paper web.

5. The machine recited in claim 3 including, heating means adjacent to said wire gauze means and operative to dry said pulp on said wire gauze.

6. The machine recited in claim 3 including, pressing means adjacent to said wire gauze means and operative to press said pulp on said wire gauze.

7. A machine for processing coconuts into paper products including, a punch means for punching a hole into the coconuts to permit liquid within the coconut to be drained;

container means located under said punch means for receiving said liquid;

blade means for cutting the coconut into at least two section;

cutter means for extracting copra from the sections of the coconut;

crusher roller means to reduce the sections of coconut husks to smaller particles;

collector means for collecting the copra;

conveyor means for supporting and conveying the coconuts or the sections of the coconuts or the granulated husks past the punch means, the blade means, the cutter means and the crusher roller means;

tank means wherein said smaller particles are mixed with water and said smaller particles are further reduced into small granules;

plate means having fixed blades thereon mounted in said tank means;

roller means with projecting blades that interact with the fixed blades on said plate means to reduce said small granules to a pulp in said tank means;

reservoir means suspended above the tank means to selectively supply an additive comprising at least one of a binding agent, bleach, and a coloring substance to said pulp in said tank means; and sensor control means for detecting the consistency of said pulp and operative to produce a signal wherein said reservoir means selectively supplies the binding agent to said pulp in order to maintain the consistency thereof within the pre-established limits whereby said pulp is used in the manufacture of paper products.

8. The machine recited in claim 7 including, finishing means to heat, press, dry and calendar said pulp into the paper product.

9. A process for manufacturing paper from coconuts which is comprised of the following method steps:

perforating coconut husks of the coconut with a punch means and draining the liquid contained within the coconut;

cutting the husks into two sections using a guillotine blade;

removing copra from inside the coconut sections using a rotational ball cutter;

section cutting to reduce the coconut sections into small portions;

reducing the size of the small portions into smaller particles using a crusher roller means;

conveying the smaller particles into a tank means;

mixing the smaller particles in the tank means with water to remove impurities therefrom and to form a pulp therefrom;

soaking the pulp with a chemical solution of sodium hydroxide or calcium hydrogen sulphite to dissolve lignose between coconut cellulose fibers in the tank means;

bleaching the coconut fibers in the tank means;

washing the bleached coconut fibers in the tank means;

adding a filler to the washed, bleached coconut fibers to form a pulp mixture and to adjust pulp consistency;

sensing the consistency of the pulp mixture using a sensor control means which produces a signal wherein a binding agent is added to the pulp mixture to form a final pulp mixture so as to maintain the consistency of the final pulp mixture within pre-established limits;

jetting the final pulp mixture from jet nozzles onto a moving wire gauze to form a continuous moving wet web; and dewatering, pressing, calendaring and drying the web to form a paper web having a smooth finish.

* * * * *